US006553950B2

(12) United States Patent
Chiappini et al.

(10) Patent No.: US 6,553,950 B2
(45) Date of Patent: Apr. 29, 2003

(54) INTERNAL-COMBUSTION ENGINE WITH VARIABLE-OPERATION VALVES AND AUXILIARY HYDRAULIC TAPPET

(75) Inventors: Stefano Chiappini, Orbassano (IT); Andrea Pecori, Orbassano (IT); Francesco Vattaneo, Orbassano (IT)

(73) Assignee: C.R.F. Societa Consortile per Azioni, Turin (IT)

( * ) Notice: Subject to any disclaimer, the term of this patent is extended or adjusted under 35 U.S.C. 154(b) by 0 days.

(21) Appl. No.: 10/102,753

(22) Filed: Mar. 22, 2002

(65) Prior Publication Data

US 2002/0134330 A1 Sep. 26, 2002

(30) Foreign Application Priority Data

Mar. 23, 2001 (IT) ..... TO2001A000272

(51) Int. Cl.[7] ..... F01L 9/02; F01L 1/25

(52) U.S. Cl. ..... 123/90.12; 123/90.16; 123/90.55; 123/198 F

(58) Field of Search ..... 123/90.12, 90.13, 123/90.15, 90.16, 90.48, 90.55, 198 F

(56) References Cited

U.S. PATENT DOCUMENTS

| | | | | | |
|---|---|---|---|---|---|
| 5,127,375 | A | * | 7/1992 | Bowman et al. | 123/90.12 |
| 5,839,400 | A | * | 11/1998 | Vattaneo et al. | 123/90.16 |
| 6,138,621 | A | * | 10/2000 | Albanello et al. | 123/90.12 |
| 6,192,841 | B1 | * | 2/2001 | Vorih et al. | 123/90.12 |
| 6,227,154 | B1 | * | 5/2001 | Wakeman | 123/90.16 |
| 6,325,028 | B1 | * | 12/2001 | Albanello et al. | 123/90.12 |
| 6,412,457 | B1 | * | 7/2002 | Vorih et al. | 123/90.12 |

* cited by examiner

*Primary Examiner*—Weilun Lo
(74) *Attorney, Agent, or Firm*—Sughrue Mion, PLLC

(57) ABSTRACT

In an internal-combustion engine with a hydraulic system for variable operation of the valves, the piston for operating each valve includes an auxiliary hydraulic tappet.

1 Claim, 4 Drawing Sheets

INTERNAL-COMBUSTION ENGINE WITH VARIABLE-OPERATION VALVES AND AUXILIARY HYDRAULIC TAPPET

BACKGROUND OF THE INVENTION

The present invention relates to internal-combustion engines of the type comprising:

at least one induction valve and at least one exhaust valve for each cylinder, each valve being provided with respective elastic means that bring back the valve into the closed position to control communication between the respective induction and exhaust ducts and the combustion chamber;

a camshaft for operating the induction and exhaust valves of the cylinders of the engine by means of respective tappets;

in which at least one of said tappets controls the respective induction or exhaust valve against the action of said elastic return means via the interposition of hydraulic means including a hydraulic chamber containing fluid under pressure;

said hydraulic chamber containing fluid under pressure being connectable, via a solenoid valve, to an outlet channel for decoupling the valve from the respective tappet and causing fast closing of the valve under the action of respective elastic return means;

said hydraulic means further comprising a piston associated to the stem of the valve and slidably mounted in a guide bushing, said piston being set facing a variable-volume chamber defined by the piston inside the guide bushing, said variable-volume chamber being in communication with the hydraulic chamber containing fluid under pressure by means of an end aperture of said guide bushing, said piston having an end appendage designed to be inserted into said end aperture during the final stretch of the closing stroke of the valve in order to restrict the communication port between said variable-volume chamber and said hydraulic chamber containing fluid under pressure, so as to slow down the stroke of the valve in the proximity of its closing.

An engine of the type referred to above is, for example, described and illustrated in the European patent applications Nos. EP-A-0 803 642 and EP-A-1 091 097 filed by the present applicant.

Studies and tests carried out by the present applicant have shown that some problems may arise during operation, and in particular noise on account of the play that may arise between the various parts both as a result of the constructional tolerances and on account of wear. In particular, it has emerged that in the course of operation of the engine, the ring which functions as a seat for the engine valve and which is received into a cavity of the engine cylinder head may undergo displacements of one or two tenths of a millimeter following upon the continuous impact of the head of the valve against the ring. So far this problem has been solved by using pads for compensating the play.

SUMMARY OF THE INVENTION

The purpose of the present invention is to overcome the above-mentioned problems.

With a view to achieving this purpose, the subject of the invention is an engine having all the characteristics referred to at the beginning of the present description and characterized moreover in that set between the stem of the valve and the aforesaid piston for actuating the valve is an auxiliary hydraulic tappet.

In the practical implementation, the aforesaid auxiliary hydraulic tappet comprises an auxiliary piston which is slidably mounted in the body of the actuating piston, has one end set inside the actuating piston and set facing a chamber within the actuating piston, the said chamber being in communication with the chamber containing fluid under pressure of the system for controlling the valves, and one end set outside the actuating piston, which is in contact with the end of the valve stem, elastic means being provided for bringing back said auxiliary piston into an end-of-stroke position in the direction of the valve stem.

Inside the aforesaid chamber made within the actuating piston, a non-return valve is set which enables passage of fluid under pressure coming from the hydraulic pressure chamber inside the chamber of the auxiliary hydraulic tappet.

As emerges clearly from the foregoing description, in the engine according to the invention, the stem of the valve is not rigidly connected to the actuating piston, given that set between them is the aforesaid auxiliary hydraulic tappet, which is thus able to recover all the possible play that may arise as a result of the fabrication tolerances or wear of the parts.

The arrangement according to the invention may be adopted both for the induction valves and for the exhaust valves, but is particularly useful in the case of the exhaust valves, in that the problems referred to above tend to occur more easily for this type of valve.

BRIEF DESCRIPTION OF THE DRAWINGS

Further characteristics and advantages of the present invention will emerge from the ensuing description, with reference to the attached drawings, which are provided purely by way of non-limiting examples, and in which.

DETAILED DESCRIPTION OF THE INVENTION

Figure 1:
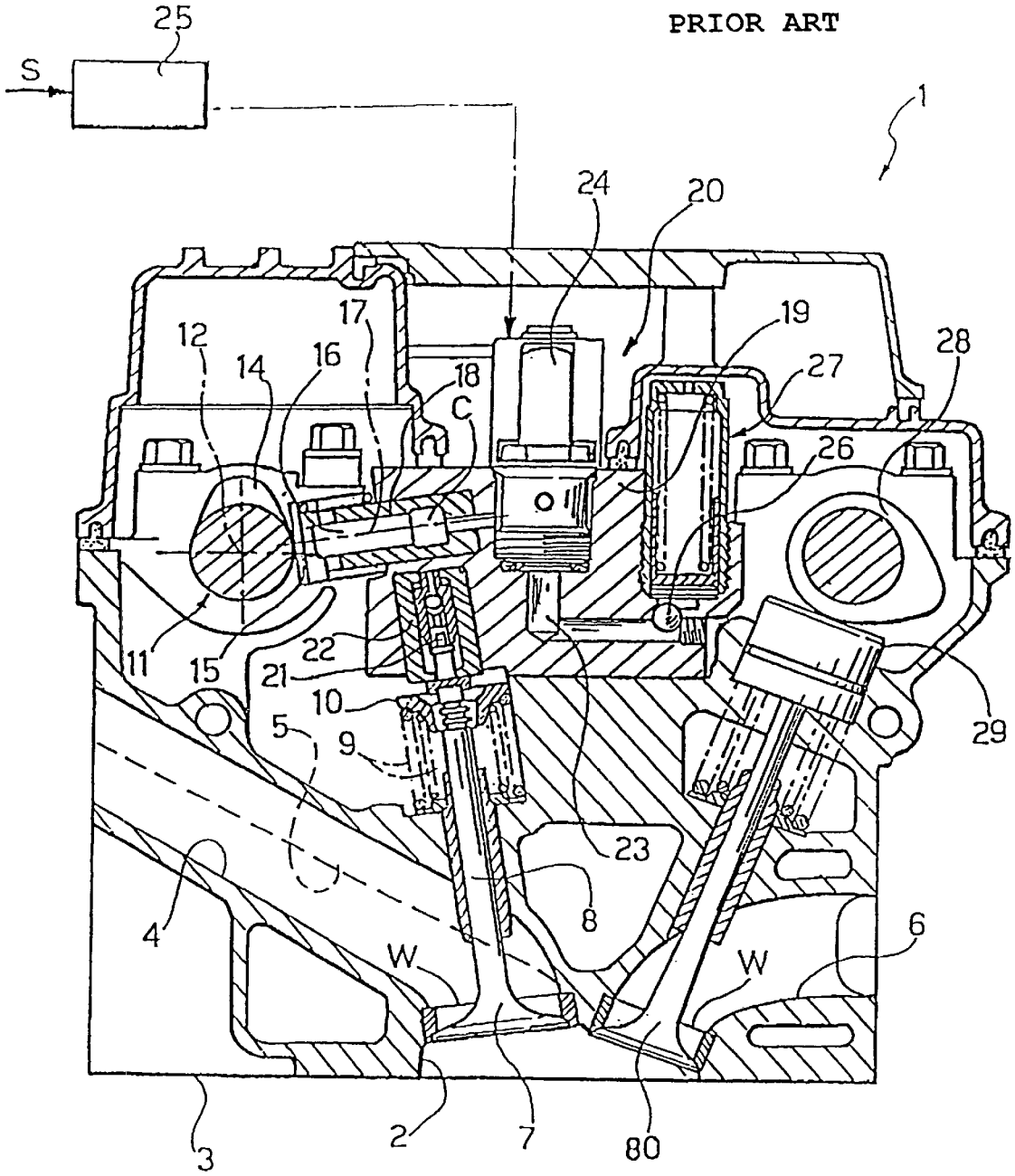
FIG. 1 PRIOR ART
FIG. 1 is a cross-sectional view of the cylinder head of an internal-combustion engine according to the embodiment known from the European patent application EP-A-0 803 642 filed by the present applicant.
Figure 2:
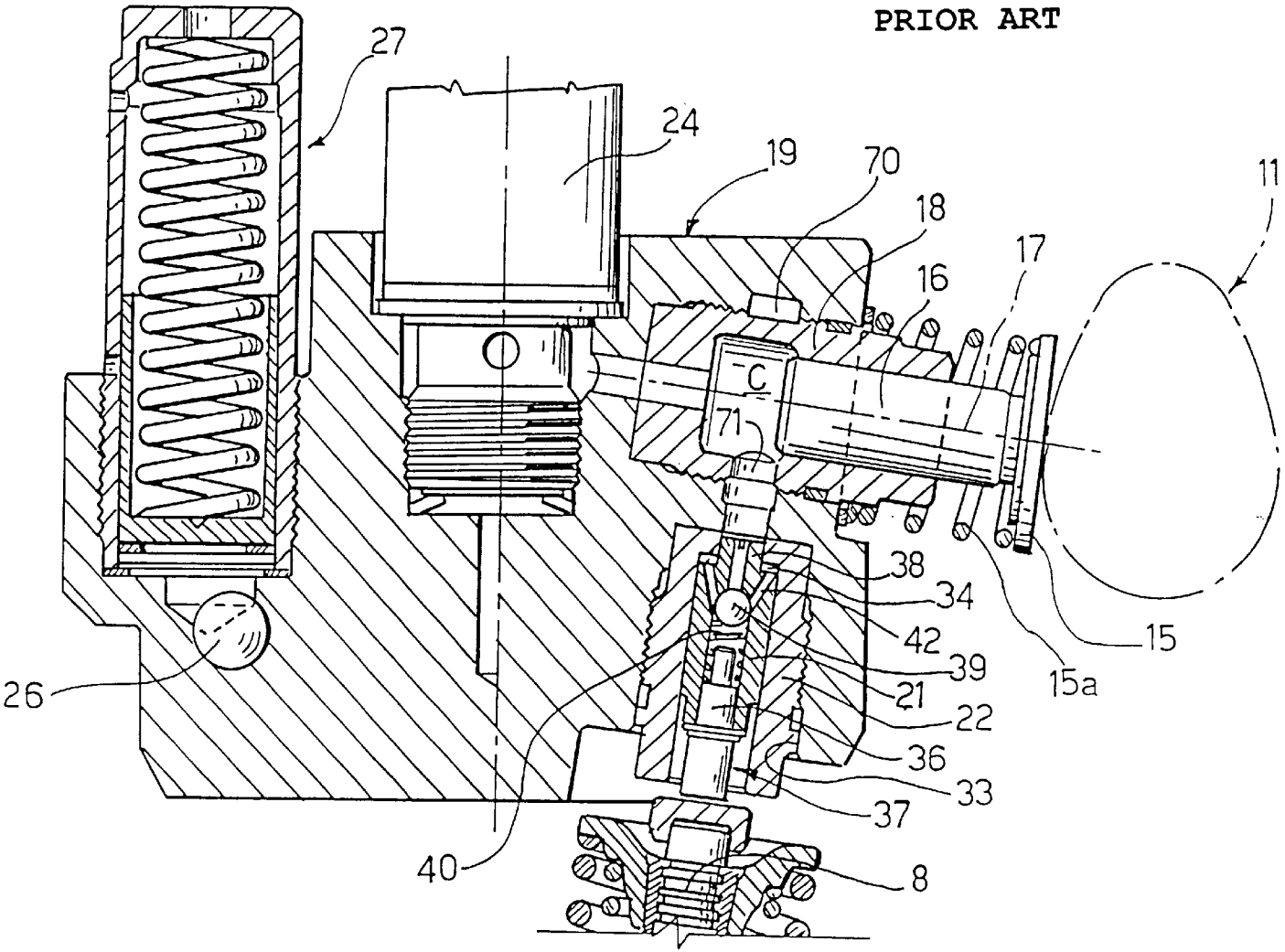
FIG. 2 PRIOR ART
FIG. 2 is a cross-sectional view at an enlarged scale of a detail of FIG. 1.

With reference to FIGS. 1 and 2, the internal combustion engine described in the prior European patent application No. EP-A-0 803 642, as well as in EP-A-1 091 097, filed by the present applicant is a multi-cylinder engine, for example, an engine with five cylinders set in line, comprising a cylindrical head 1.

The head 1 comprises, for each cylinder, a cavity 2 formed in the base surface 3 of the head 1, the said cavity 2 defining the combustion chamber into which two induction ducts 4, 5 and two exhaust ducts 6 give out. Communication of the two induction ducts 4, 5 with the combustion chamber 2 is controlled by two induction valves 7 of the traditional poppet or mushroom type, each comprising a stem 8 slidably mounted in the body of the head 1. Each valve 7 is brought back to the closing position by springs 9 set between an inner surface of the head 1 and an end cup 10 of the valve. Opening of the induction valves 7 is controlled, in the way that will be described in what follows, by a camshaft 11 which is slidably mounted about an axis 12 within supports of the head 1 and which comprises a plurality of cams 14 for operating the valves.

Each cam 14 for operating an induction valve 7 cooperates with the cap 15 of a tappet 16 slidably mounted along an axis 17, which in the case illustrated is directed substantially at 90° with respect to the axis of the valve 7 (the tappet may also be mounted so that it is aligned, as will be illustrated with reference to FIG. 3), within a bushing 18 carried by a body 19 of a pre-assembled subassembly 20 that incorporates all the electrical and hydraulic devices associated to operation of the induction valves, according to what is illustrated in detail in what follows. The tappet 16 is able to transmit a thrust to the stem 8 of the valve 7 so as to cause opening of the latter against the action of the elastic means 9 via fluid under pressure (typically oil coming from the engine-lubrication circuit) present in a chamber C and a piston 21 slidably mounted in a cylindrical body constituted by a bushing 22, which is also carried by the body 19 of the subassembly 20. Again according to the known solution illustrated in FIG. 1, the chamber C containing fluid under pressure associated to each induction valve 7 can be set in communication with an outlet channel 23 via a solenoid valve 24. The solenoid valve 24, which may be of any known type suitable for the function illustrated herein, is controlled by electronic control means, designated as a whole by 25, according to the signals S indicating operating parameters of the engine, such as the position of the accelerator and the engine r.p.m. When the solenoid valve 24 is opened, the chamber C enters into communication with the channel 23, so that the fluid under pressure present in the chamber C flows into said channel, and a decoupling of the tappet 16 of the respective induction valve 7 is obtained, the said induction valve 7 then returning rapidly into its closed position under the action of the return spring 9. By controlling the communication between the chamber C and the outlet channel 23, it is therefore possible to vary the opening time and opening stroke of each induction valve 7 as desired.

The outlet channels 23 of the various solenoid valves 24 all open out into one and the same longitudinal channel 26, which communicates with one or more pressure accumulators 27, only one of which can be seen in FIG. 1. All the tappets 16 with the associated bushings 18, the pistons 21 with the associated bushings 22, and the solenoid valves 24 and the corresponding channels 23, 26 are carried and made in the aforesaid body 19 of the pre-assembled subassembly 20, to the advantage of speed and ease of assembly of the engine.

The exhaust valves 80 associated to each cylinder are controlled, in the embodiment illustrated in FIG. 1, in a traditional way by a camshaft 28 by means of respective tappets 29.

FIG. 2 illustrates, at an enlarged scale, the body 19 of the pre-assembled subassembly.

FIG. 2 illustrates in detail the makeup of the piston 21. In a way of itself known, the piston 21 has a tubular body slidably mounted inside the bushing 22 and defining, within said bushing, a variable-volume chamber 34, which communicates with the chamber C containing fluid under pressure by means of an end central aperture 35 made in the bushing 22.

In the case of the known solution illustrated in FIG. 2, the opposite end of the piston 21 is drive-fitted on an end portion 36 of a stem 37 associated to the stem 8 of the valve 7. During normal operation, when the cam 14 governs opening of the valve 7 it causes the displacement of the tappet 16, so bringing about a transfer of fluid under pressure from the chamber C to the chamber 34 and the consequent opening of the valve 7 against the action of the spring 9. The chamber C communicates with an annular chamber 70 by means of radial holes 71 made in the bushing 18. The annular chamber 70 communicates with the cylinders associated to the two valves 7. According to the prior art, fast closing of the valve may be obtained by emptying the chamber C of oil under pressure by means of opening of the solenoid valve 24. In this case, the valve 7 quickly returns to its closing position under the action of the spring 9. To prevent any excessively violent impact of the valve 7 against the seat, when the valve 7 is just about to reach its closing position it is slowed down. This result is obtained, again according to the prior art, by hydraulic braking means, which consist of an end central appendage 38 provided on the tubular piston 21 and designed to insert into an aperture in the bottom wall of the bushing 22 during the final stretch of the closing stroke of the valve. During the closing stroke, the piston 21 is displaced upwards (with reference to FIG. 3), and the variable-volume chamber 34 reduces in volume, so that the oil under pressure is pushed in the direction of the chamber C. When the end appendage 38 of the piston 21 enters the end aperture of the bushing 22, the return of oil under pressure from the chamber 34 to the chamber C takes place, in the case of the prior art, through the small gaps (not visible in the drawing), caused by the play, which are present between the appendage 38 and the wall of the aperture 35. The outflow of oil is thus considerably slowed down, and consequently the stroke of the valve is also slowed down. Again according to the prior art, also associated to the cylinder 21 is a non-return valve which comprises a spherical open-close element 39 pushed inside the tubular body of the piston 21 by a spring 40 towards a position in which it obstructs an end central hole 41 of the piston 21 which extends starting from the inner cavity of the piston 21 until it comes out onto the end facing the chamber C. The inner chamber of the piston 21 moreover communicates with side passages 42 that come out onto the end annular surface of the piston 21, the said surface surrounding the appendage 38 and being set facing the chamber 34. As has already been said, the structure described above is also known.

Operation of the spherical open-close element 39 is described in what follows. During the closing stroke of the valve 7, the spherical open-close element 39 is kept in its closing position by the spring 40 and by the pressure of the oil in the chamber 34. When the chamber C is emptied of oil under pressure by opening of the solenoid valve 20, the valve 7 quickly returns to its closing position under the action of the spring 9, except for the fact that it is slowed down immediately prior to closing as a result of the engagement of the appendage 38 in the aperture 35, so as to prevent any violent impact of the valve against its seat. When the valve is instead opened, to enable a fast transmission of the pressure exerted by the cam 14 via the tappet 16 to the piston 21, the spherical open-close element 39 is displaced into the open position against the action of the spring 40 as a result of the thrust exerted by the fluid under pressure coming from the chamber C. Opening of the spherical open-close element 39 causes the pressure to be communicated, via the hole 41 and the side holes 42, directly to the end annular surface of the piston 21 that is set facing the chamber 34, so as to be able to exert a high force on the piston 21 even when the appendage 38 is still within the aperture 35.

As already mentioned at the beginning of the present description, the drawback that occurs in the known solution described above lies in the fact that play may be set up between the various parts of the device both on account of the fabrication tolerances and as a result of wear, in particular in the area corresponding to the rings W (FIG. 1), which function as seats for the heads of the valve, the said heads moving backwards by one or two tenths of a millimeter into their respective seats as a result of the continuous impact of the valves. In the known solutions, this leads to the need to use pads for regulating the play, with all the problems that this solution entails in terms of waste of time and complications.

Figure 3:
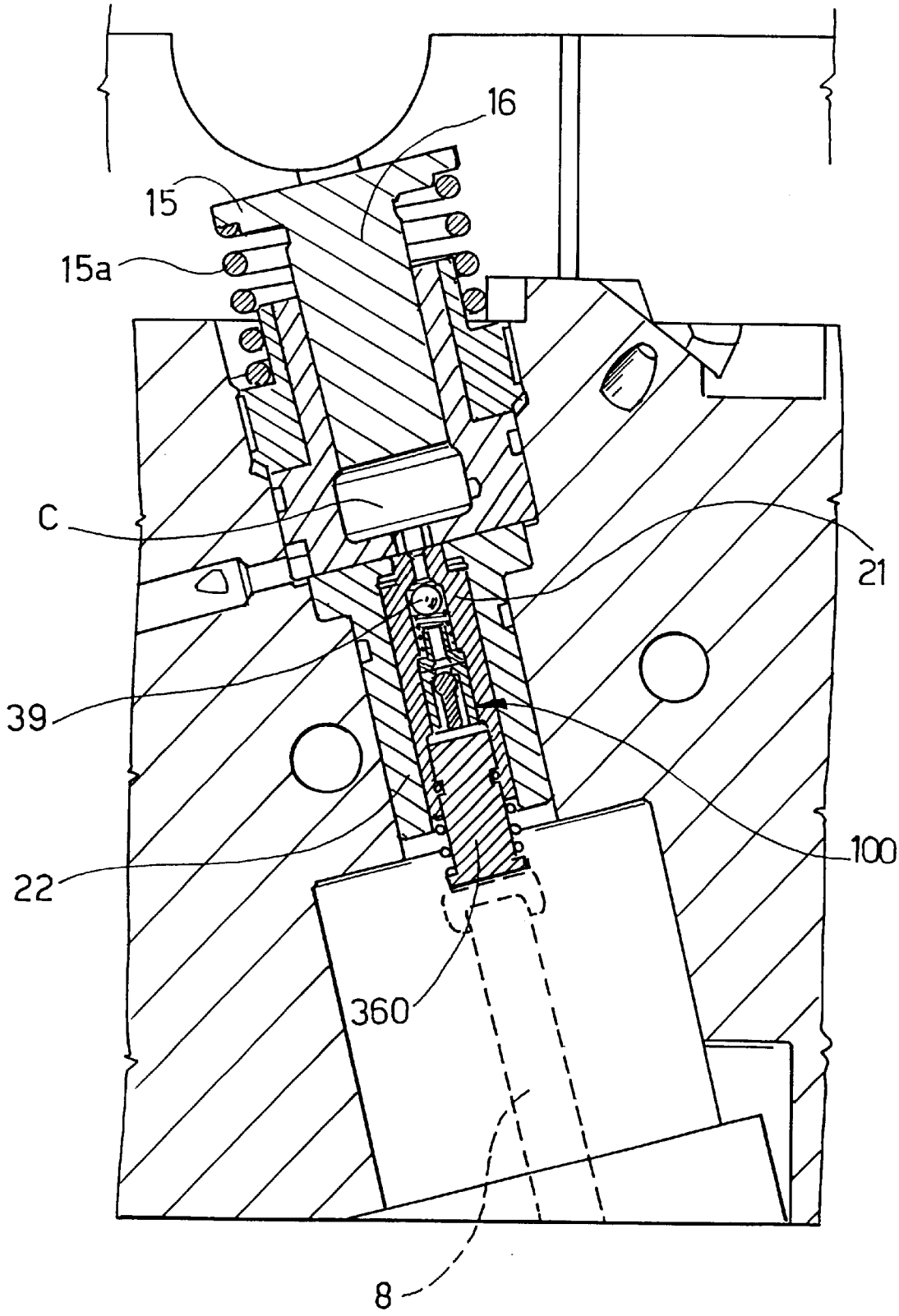
FIG. 3 is a cross-sectional view at an enlarged scale of a detail of the engine according to the invention.
Figure 4:
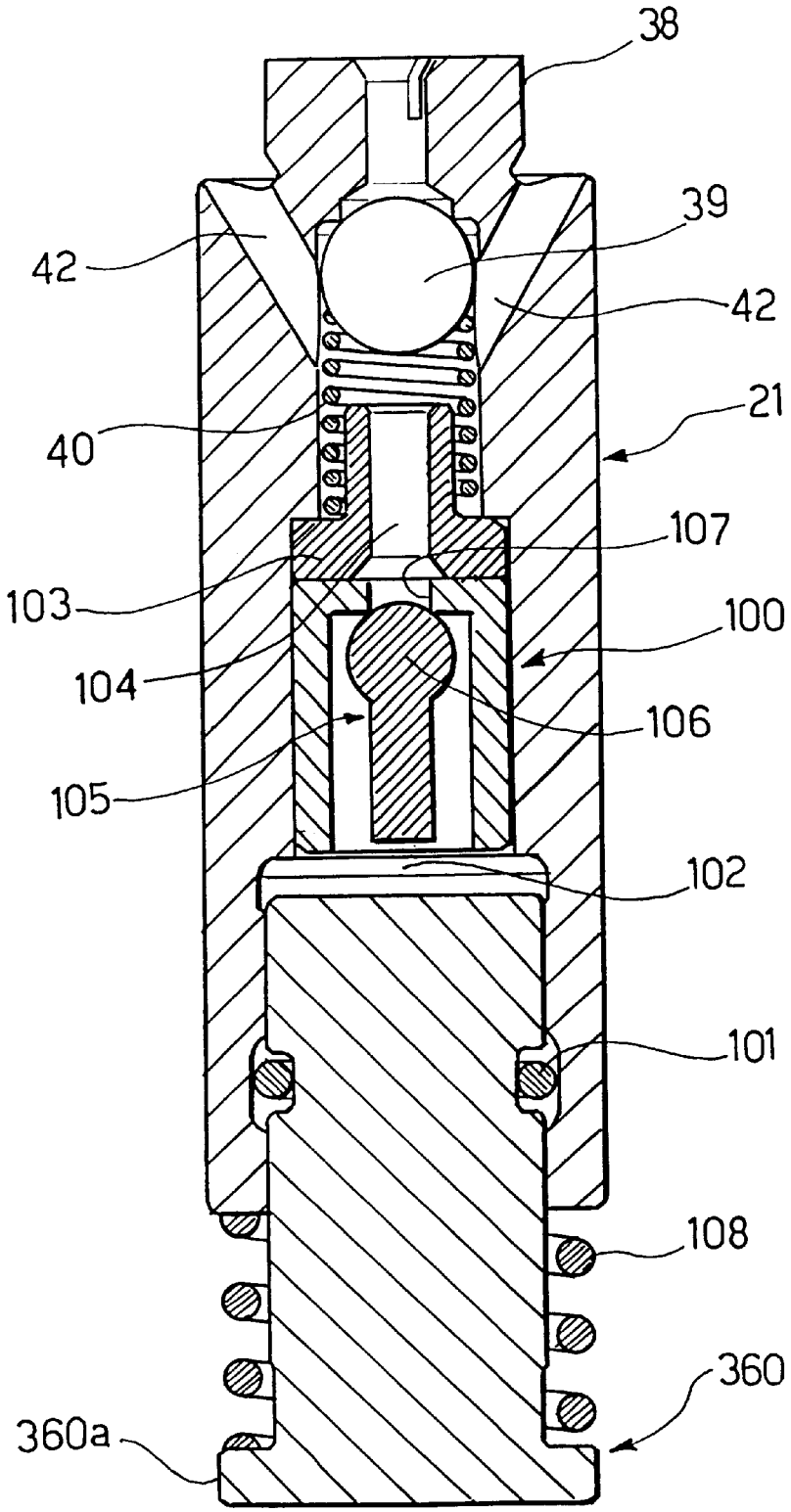
FIG. 4 is a view at an even more enlarged scale of a detail of FIG. 3.

In order to overcome the above problem, the device for actuating the valve is modified as illustrated in FIGS. 3 and 4. FIG. 3 illustrates a simplified version of the valve-control system, in which the axis of the tappet 16 is aligned with the axis of the stem 8 of the valve (not illustrated in FIG. 3). In FIGS. 3 and 4 the parts that are in common with FIGS. 1 and 2 are designated by the same reference numbers.

As emerges clearly in particular from FIG. 4, the body 21 of the actuating piston carries an auxiliary piston 360, which, unlike the stem 37 of FIG. 2, is not rigidly connected to the body 21. The auxiliary piston 360 is slidably mounted inside the tubular body of the actuating piston 21 with the interposition of a gasket which functions as an end-of-stroke element 101. The auxiliary piston 360 has one end set inside the actuating piston 21 and set facing a chamber under pressure 102 of an auxiliary hydraulic tappet 100. The return spring 40 of the spherical open-close element 39 rests against the head of a T bushing 103 which is fixed against an inner shoulder of the piston 21 and which has an internal hole 104 that sets the chamber 102 in communication with the holes 42, which in turn have the function of providing communication with the chamber C under pressure through the variable-volume chamber 34. The aforesaid communication of the pressure chamber 102 of the auxiliary hydraulic tappet with the circuit of the oil under pressure is controlled by a non-return valve 105, which, in the example illustrated, consists of a bushing made of metal material that carries, by means of radial diaphragms (not illustrated), a spherical open-close element 106, which is elastically pushed into a position for closing a hole 107 made in the bottom wall of the bushing 105. The spherical open-close element 106 enables passage of oil under pressure in the direction of the pressure chamber 102 while it is closing, so isolating said chamber, to prevent a flow in the opposite direction.

The auxiliary piston 360 has a cap-like end 360*a* set outside the actuating piston 21, which is in contact with the upper end of the stem 8 of the valve. The auxiliary piston 360 is brought back into an end-of-stroke position, in the direction of the valve stem 8, by a spring 108 set between the cap-like end 360*a* and the end of the piston 21 facing said cap-like end 360*a*.

During operation, the chamber 102 fills up with oil under pressure and consequently ensures that the transmission chain made up of the piston 21, the auxiliary piston 360, and the valve stem 8 operates properly, i.e., without any play that might lead to operating defects and/or noise.

Of course, the conformation and arrangement of the auxiliary hydraulic tappet 105 may also be altogether different from the one illustrated in the drawings purely by way of example.

What is claimed is:

1. An internal-combustion engine comprising:

at least one induction valve and at least one exhaust valve for each cylinder, each valve being provided with respective elastic means that brings back the valve into the closed position to control communication between a respective induction and exhaust ducts and a combustion chamber;

a camshaft for operating the induction and exhaust valves of the cylinders of the engine by means of respective tappets, in which at least one of said tappets controls the respective induction or exhaust valve against the action of said elastic return means via the interposition of hydraulic means including a hydraulic chamber (C) containing fluid under pressure;

said hydraulic chamber containing fluid under pressure being connectable, via a solenoid valve, to an outlet channel for decoupling the valve from the respective tappet and causing fast closing of the valve under the action of respective elastic return means;

said hydraulic means further comprising an actuating piston associated to the stem of the valve and slidably mounted in a guide bushing, said piston being set facing a variable-volume chamber defined by the piston and the guide bushing, said variable-volume chamber being in communication with the hydraulic chamber (C) containing fluid under pressure by means of a communication port constituted by an end aperture of said guide bushing, said piston having an end appendage designed to be inserted into said end aperture during a final stretch of a closing stroke of the valve in order to restrict the communication port between said variable-volume chamber and said hydraulic chamber containing fluid under pressure, so as to slow down the stroke of the valve in proximity of its closing, wherein set between the valve stem and the aforesaid piston (21) for actuating the valve is an auxiliary hydraulic tappet, and wherein the aforesaid hydraulic tappet comprises an auxiliary piston slidably mounted inside the body of the actuating piston and having one end that is set inside the actuating piston and set facing a chamber within the actuating piston which is in communication with the hydraulic chamber containing fluid under pressure, and one end set outside the actuating piston, which is in contact with the end of the valve stem, elastic means being provided for bringing back said auxiliary piston into an end-of-stroke position in the direction of the valve stem.

* * * * *